US009123984B2

(12) United States Patent
Katipally et al.

(10) Patent No.: US 9,123,984 B2
(45) Date of Patent: Sep. 1, 2015

(54) NON-RESONANT NODE FILTER

(75) Inventors: Raja Reddy Katipally, Cheshire, CT (US); Andrzej E. Stanek, New Haven, CT (US)

(73) Assignee: Alcatel Lucent, Boulogne-Billancourt (FR)

( * ) Notice: Subject to any disclaimer, the term of this patent is extended or adjusted under 35 U.S.C. 154(b) by 310 days.

(21) Appl. No.: 13/404,298

(22) Filed: Feb. 24, 2012

(65) Prior Publication Data

US 2013/0222080 A1 Aug. 29, 2013

(51) Int. Cl.

| | |
|---|---|
| ***H01P 1/20*** | (2006.01) |
| ***H01P 11/00*** | (2006.01) |
| ***H01P 1/205*** | (2006.01) |
| ***H01P 1/208*** | (2006.01) |

(52) U.S. Cl.

CPC ..... *H01P 1/2053* (2013.01); *H01P 1/208* (2013.01); *Y10T 29/49016* (2015.01)

(58) Field of Classification Search

CPC ..... H01P 7/06; H01P 1/205; H01P 1/2053; Y10T 29/49016

USPC ..... 333/204, 227, 203

See application file for complete search history.

(56) References Cited

U.S. PATENT DOCUMENTS

2010/0188174 A1* 7/2010 Zhang et al. ..... 333/203

OTHER PUBLICATIONS

Amari et al., Synthesis of inline filters with arbitrarily placed attenuation poles by using nonresonating nodes, Oct. 2005, IEEE Transactions on Microwave Theory and Techniques, pp. 3075-3081.*

Macchiarella et al., Exact Synthesis of a Low-Pass Prototype for the Accurate Design of Single-Sided Filters, Sep. 2006, Proceedings of the 36th European Microwave Conference. pp. 894-897.*

* cited by examiner

*Primary Examiner* — Stephen E Jones
*Assistant Examiner* — Scott S Outten
(74) *Attorney, Agent, or Firm* — Kramer & Amado, P.C.

(57) ABSTRACT

Various exemplary embodiments relate to a filter configured to operate in an operational frequency range. The filter may include a mainline, at least one combline resonator coupled to the mainline, an input port coupled to the mainline, and an output port coupled to the mainline. The mainline may include at least one non-resonant node. The at least one non-resonant node may be configured to resonate in a frequency range outside of the operational frequency range of the filter, and the at least one combline resonator may be configured to resonate in a frequency range within the operational frequency range of the filter.

20 Claims, 6 Drawing Sheets

NON-RESONANT NODE FILTER

TECHNICAL FIELD

Various exemplary embodiments disclosed herein relate generally to cavity filters for radio, microwave, or other high frequency signals.

BACKGROUND

Cavity structures may act as resonant circuits for electromagnetic signals. One or more cavities may be combined to create a filter.

SUMMARY

A brief summary of various exemplary embodiments is presented. Some simplifications and omissions may be made in the following summary, which is intended to highlight and introduce some aspects of the various exemplary embodiments, but not to limit the scope of the invention. Detailed descriptions of exemplary embodiments adequate to allow those of ordinary skill in the art to make and use the inventive concepts will follow in later sections.

Various exemplary embodiments relate to a filter configured to operate in an operational frequency range, including: a mainline comprising at least one non-resonant node, wherein the at least one non-resonant node is configured to resonate in a frequency range outside of the operational frequency range of the filter; at least one combline resonator coupled to the mainline, wherein the at least one combline resonator is configured to resonate in a frequency range within the operational frequency range of the filter; an input port coupled to the mainline; and an output port coupled to the mainline.

In some embodiments, the mainline comprises at least two non-resonant nodes. In some embodiments, the filter further includes at least two combline resonators, wherein a first combline resonator is coupled to a first non-resonant node, and a second combline resonator is coupled to a second non-resonant node. In some embodiments, the filter rejects a first range of frequencies within the operational frequency range based on a first tuning of the filter, and wherein the filter rejects a second range of frequencies within the operational frequency range based on a second tuning of the filter. In some embodiments, the at least one non-resonant node and the at least one combline resonator are integral to the filter.

Various exemplary embodiments further relate to a method for manufacturing a filter configured to operate in an operational frequency range, the method including: forming a mainline comprising at least one non-resonant node, wherein the at least one non-resonant node is configured to resonate in a frequency range outside of the operational frequency range of the filter; forming at least one combline resonator coupled to the mainline, wherein the at least one combline resonator is configured to resonate in a frequency range within the operational frequency range of the filter; forming an input port coupled to the mainline; and forming an output port coupled to the mainline.

In some embodiments, the mainline comprises at least two non-resonant nodes. In some embodiments, the method further includes forming at least two combline resonators, wherein a first combline resonator is coupled to a first non-resonant node, and a second combline resonator is coupled to a second non-resonant node. In some embodiments, the filter rejects a first range of frequencies within the operational frequency range based on a first tuning of the filter, and wherein the filter rejects a second range of frequencies within the operational frequency range based on a second tuning of the filter. In some embodiments, the at least one non-resonant node and the at least one combline resonator are integral to the filter.

BRIEF DESCRIPTION OF THE DRAWINGS

In order to better understand various exemplary embodiments, reference is made to the accompanying drawings, wherein.

DETAILED DESCRIPTION

Figure 1:
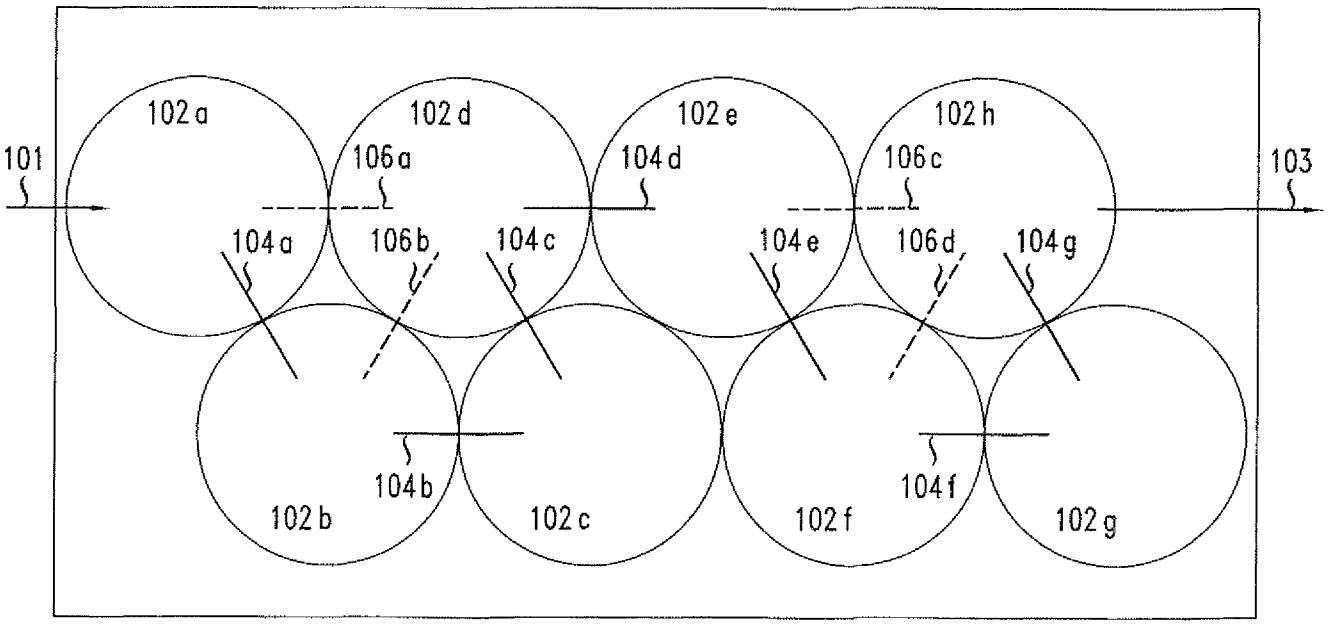
FIG. 1 (PRIOR ART)
FIG. 1 illustrates an embodiment of a conventional combline filter.

Referring now to the drawings, in which like numerals refer to like components or steps, there are disclosed broad aspects of various exemplary embodiments.

FIG. 1 illustrates an embodiment of a conventional combline filter 100. The conventional combline filter 100 may include eight combline resonators 102*a*-102*h*. A signal may be input to the combline resonator 102*a* via an input port 101. A filtered signal may exit the combline resonator 102*h* via an output port 103. Seven mainline coupling elements 104*a*-104*g* may couple the eight combline resonators 102*a*-102*h*. Four cross-coupling elements 106*a*-106*d* may couple pairs of combline resonators. Cross-coupling element 106*a* may couple combline resonator 102*d* and combline resonator 102*d*. Cross-coupling element 106*b* may couple combline resonator 102*b* and combline resonator 102*d*. Cross-coupling element 106*c* may couple combline resonator 102*e* and combline resonator 102*h*. And cross-coupling element 106*d* may couple combline resonator 102*f* and combline resonator 102*h*.

While eight combline resonators, seven mainline coupling elements, and four cross-coupling elements are shown, the number of combline resonators, mainline coupling elements, and cross-coupling elements may vary based on a desired capability of the conventional combline filter 100.

The mainline coupling elements 104*a*-104*g* and the cross-coupling elements 106*a*-106*d* may be positive or negative depending on a desired frequency rejection. For example, if greater frequency rejection is desired for frequencies above the passband of the combline filter 100, then the mainline coupling elements 104*a*-104*g* and the cross-coupling elements 106*a*-106*d* may all be positive. If greater frequency rejection is desired for frequencies below the passband of the combline filter 100, then the seven mainline coupling elements 104*a*-104*g* may be positive, cross-coupling elements 106*a* and 106*c* may be positive, and cross-coupling elements 106*b* and 106*d* may be negative.

Figure 2:
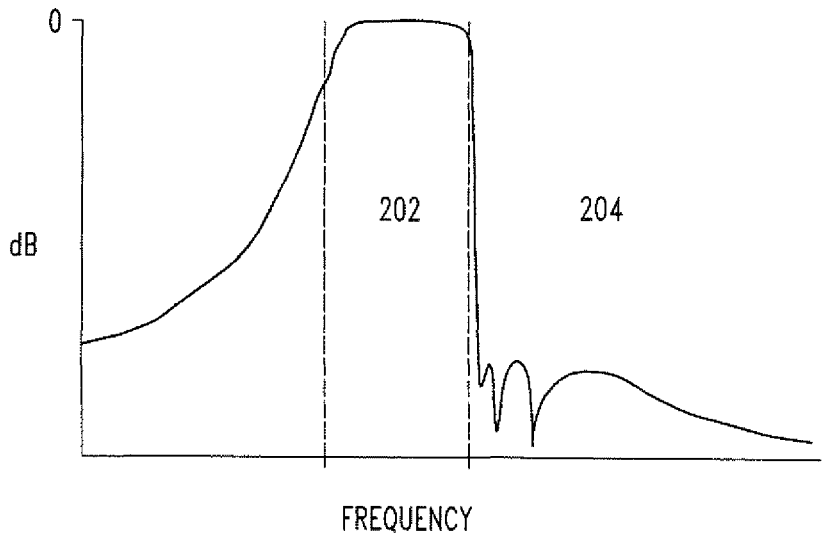
FIG. 2 (PRIOR ART)
FIG. 2 illustrates an example of the frequency response of a conventional combline filter.

FIG. 2 illustrates an example of the frequency response of a conventional combline filter. A passband region 202 may be a range of frequencies that are not significantly filtered by the combline filter. A rejection region 204 may be a range of frequencies that are minimized by the combline filter. The example of FIG. 2 illustrates a combline filter with greater frequency rejection above the passband region 202.

Achieving a desired frequency rejection near a passband with the conventional combline filter 100 may require precise design of the four cross-coupling elements 106*a*-106*d* and other filter components. Due to the precise design requirements, the conventional combline filter 100 may have a complex and time-consuming assembly process.

Figure 3:
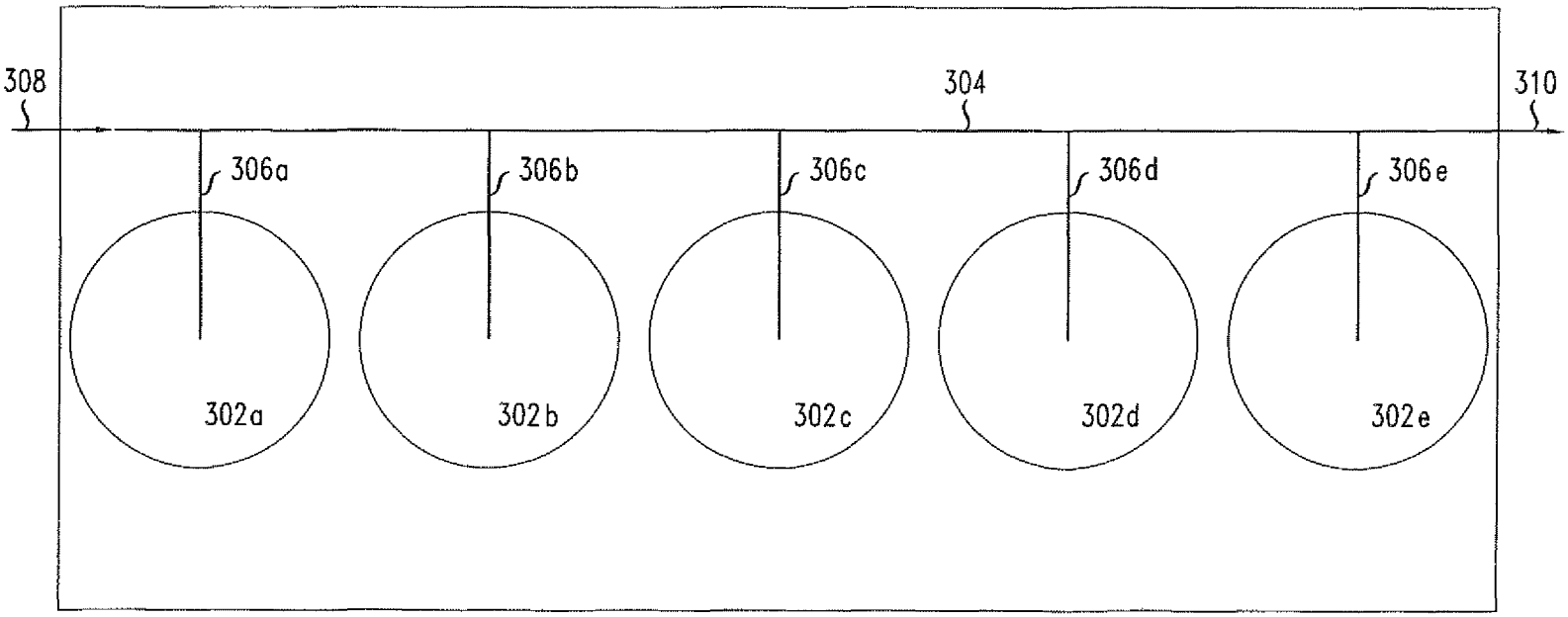
FIG. 3 (PRIOR ART)
FIG. 3 illustrates an embodiment of a conventional notch filter.

FIG. 3 illustrates an embodiment of a conventional notch filter 300. The conventional notch filter 300 may include five combline resonators 302*a*-302*e* arranged in a notch configuration. Each of the five combline resonators 302*a*-302*e* may be coupled to a transmission line 304 by five coupling strips 306*a*-306*e*. A signal may be input to the transmission line 304 via an input port 308. A filtered signal may exit the transmission line 304 via an output port 310.

While five combline resonators and five coupling strips are shown, the number of combline resonators and coupling strips may vary based on a desired capability of the conventional notch filter 300.

Figure 4:
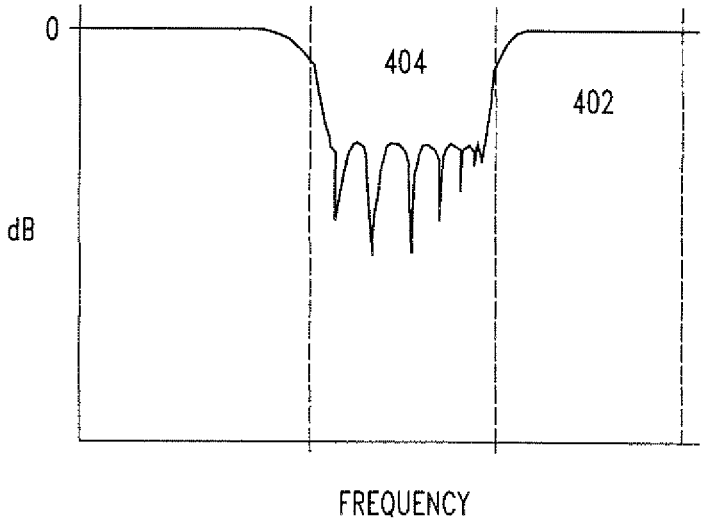
FIG. 4 (PRIOR ART)
FIG. 4 illustrates an example of the frequency response of a conventional notch filter.

FIG. 4 illustrates an example of the frequency response of a conventional notch filter. A passband region 402 may be a range of frequencies that are not significantly filtered by the combline filter. A rejection region 404 may be a range of frequencies that are minimized by the notch filter. The example of FIG. 4 illustrates a notch filter with greater frequency rejection below the passband region 402.

The combline resonators 302*a*-302*e*, transmission line 304, and coupling strips 306*a*-306*e* of the conventional notch filter 300 may each be individual and separate components. Each component may need to be individually assembled and tuned for the conventional notch filter 300 to achieve a desired frequency rejection. Due to the amount of separate components and involved tuning process, the conventional notch filter 300 may have a complex and time-consuming assembly process.

Figure 5:
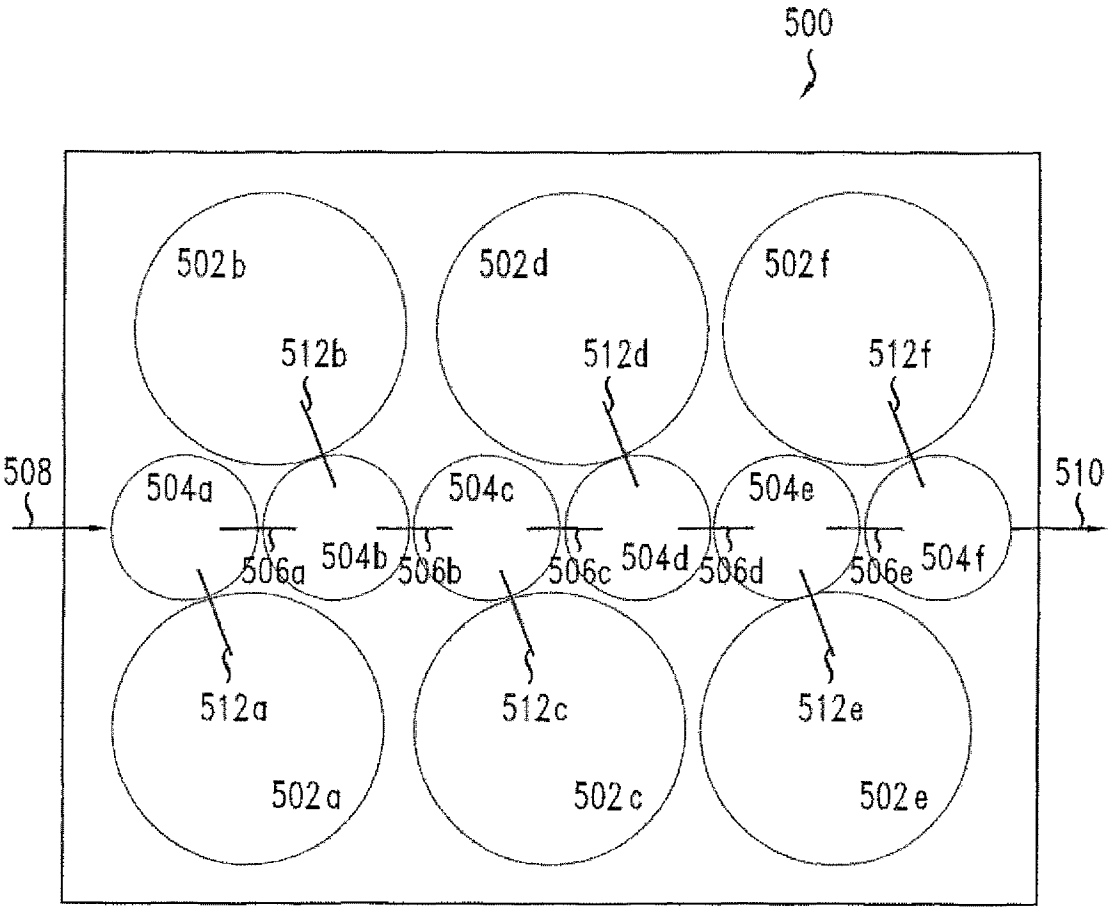
FIG. 5 illustrates an embodiment of a non-resonant node filter.

FIG. 5 illustrates an embodiment of a non-resonant node filter 500. The non-resonant node filter 500 may include six combline resonators 502*a*-502*f* and six non-resonant nodes 504*a*-504*f*. The six non-resonant nodes 504*a*-504*f* may be coupled to each other by five mainline coupling elements 506*a*-506*e*. The non-resonant nodes 504*a*-504*f* may be configured to resonate at frequencies far outside of a desired passband. By not resonating in the desired passband, the six non-resonant nodes 504*a*-504*f* and five mainline coupling elements 506*a*-506*e* may form a mainline. A signal may be input to the mainline via an input port 508 connected to non-resonant node 504*a*. A filtered signal may exit the mainline via an output port 510 connected to non-resonant node 504*f*.

The six combline resonators 502*a*-502*f* may be coupled to the mainline via six combline coupling elements 512*a*-512*f*. Combline coupling element 512*a* may couple combline resonator 502*a* to non-resonant node 504*a*. Combline coupling element 512*b* may couple combline resonator 502*b* to non-resonant node 504*b*. Combline coupling element 512*c* may couple combline resonator 502*c* to non-resonant node 504*c*. Combline coupling element 512*d* may couple combline resonator 502*d* to non-resonant node 504*d*. Combline coupling element 512*e* may couple combline resonator 502*e* to non-resonant node 504*e*. Combline coupling element 512*f* may couple combline resonator 502*f* to non-resonant node 504*f*. The mainline coupling elements 506*a*-506*f* and combline coupling elements 512*a*-512*f* may be the same type of coupling elements.

While six combline resonators, six non-resonant nodes, five mainline coupling elements, and six combline coupling elements are shown, the number of combline resonators, non-resonant nodes, mainline coupling elements, and combline coupling elements may vary based upon a desired capability of the non-resonant node filter 500.

The combline resonators 502*a*-502*f*, non-resonant nodes 504*a*-504*f*, mainline coupling elements 506*a*-506*e*, and combline coupling elements 512*a*-512*f* may be integral parts of the non-resonant node filter 500. The integral parts of the non-resonant node filter 500 may allow the non-resonant node filter 500 to be less complex to assemble and tune than the conventional combline filter 100 and conventional notch filter 300.

Figure 6A:
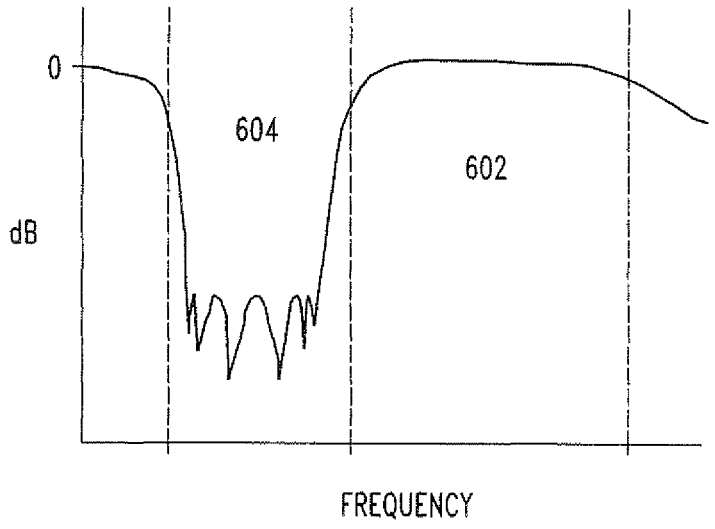
FIG. 6A illustrates an example of the frequency responses of the non-resonant node filter.
Figure 6B:
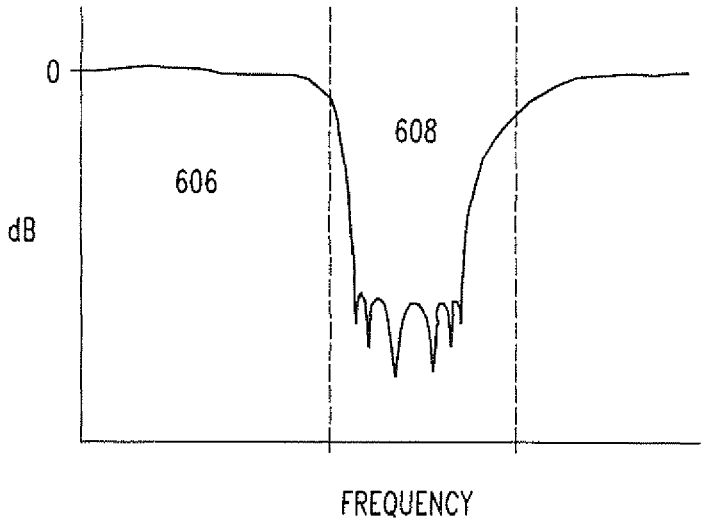
FIG. 6B illustrates another example of the frequency responses of the non-resonant node filter.

FIGS. 6A and 6B illustrate examples of frequency responses that may be achieved with the non-resonant node filter 500. The example of FIG. 6A may have a rejection region 604 below a passband region 602. The rejection region 604 may be a range of frequencies that may be minimized based on a tuning of the non-resonant node filter 500. The frequencies in the passband region 602 may not be significantly filtered by the non-resonant node filter 500 when the non-resonant node filter 500 is tuned to the rejection region 604.

The example of FIG. 6B may have a rejection region 608 above a passband region 606. The rejection region 608 may be a range of frequencies that may be minimized based on a different tuning of the non-resonant node filter 500 than the example of FIG. 6A. The frequencies in the passband region 606 may not be significantly filtered by the non-resonant node filter 500 when the non-resonant node filter 500 is tuned to the rejection region 608. In this way, the non-resonant node filter 500 may reject different ranges of frequencies based upon the tuning of the non-resonant node filter 500. The components of the non-resonant node filter 500 may not need to be redesigned for the non-resonant node filter 500 to reject different ranges of frequencies, only the tuning of the non-resonant node filter 500 may need to be adjusted. The tuning of the non-resonant node filter 500 may be adjusted by tuning the frequencies of the combline resonators 502*a*-502*f* and/or the values of the combline coupling elements 512*a*-512*f*. Further modification to the design of the non-resonant node filter 500 may not be necessary to shift the rejection regions above or below a passband region.

According to the foregoing, various exemplary embodiments provide for a filter that may be easier to assemble and tune than conventional filters. Further, various exemplary embodiments provide for a filter that may be easier to configure to reject different ranges of frequencies than conventional filters.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only and do not in any way limit the invention, which is defined only by the claims.

What is claimed is:

1. A filter configured to operate in an operational frequency range, comprising:

a mainline, disposed along a central axis, comprising at least one non-resonant node, wherein the at least one non-resonant node is configured to resonate in a frequency range outside of the operational frequency range of the filter;

a combline filter coupled to the mainline, wherein the combline filter is configured to resonate in a frequency range within the operational frequency range of the filter, the combline filter comprises a first subset of combline resonators and a second subset of combline resonators, and the first subset of combline resonators and the second subset of combline resonators are located on opposite sides of the central axis;

an input port coupled to the mainline; and an output port coupled to the mainline.

2. The filter of claim 1, wherein a non-resonant node filter is tuned to a rejection region.

3. The filter of claim 2, wherein the rejection region is below a passband region of the combline filter.

4. The filter of claim 2, wherein the rejection region is above a passband region of the combline filter.

5. The filter of claim 1, wherein the mainline comprises at least two non-resonant nodes.

6. The filter of claim 5, wherein a first combline resonator of the first subset of combline resonators is coupled to a first non-resonant node, and a second combline resonator of the second subset of combline resonators is coupled to a second non-resonant node.

7. The filter of claim 1, wherein the mainline comprises six non-resonant nodes.

8. The filter of claim 7, wherein the six non-resonant nodes are coupled to each other by five mainline coupling elements.

9. The filter of claim 1, wherein the filter is configured to reject a first range of frequencies within the operational frequency range based on a first tuning of the filter, and reject a second range of frequencies within the operational frequency range based on a second tuning of the filter.

10. The filter of claim 1, wherein the at least one non-resonant node and the combline filter are integral to the filter.

11. The filter of claim 1, wherein the input port is coupled to the at least one non-resonant node.

12. The filter of claim 1, wherein the output port is coupled to the at least one non-resonant node.

13. The filter of claim 1, further comprising:

combline coupling elements that are configured to couple the combline filter to the at least one non-resonant node.

14. A method for manufacturing a filter configured to operate in an operational frequency range, the method comprising:

forming a mainline, disposed along a central axis, comprising at least one non-resonant node, wherein the at least one non-resonant node is configured to resonate in a frequency range outside of the operational frequency range of the filter;

forming a combline filter comprising a first subset of combline resonators and a second subset of combline resonators coupled to the mainline, wherein the first subset of combline resonators and the second subset of combline resonators are located on opposite sides of the central axis and the combline filter is configured to resonate in a frequency range within the operational frequency range of the filter;

forming an input port coupled to the mainline; and forming an output port coupled to the mainline.

15. The method of claim 14, wherein the mainline comprises at least two non-resonant nodes.

16. The method of claim 15, further comprising:

coupling a first combline resonator of the first subset of combline resonators to a first non-resonant node; and coupling a second combline resonator of the second subset of combline resonators to a second non-resonant node.

17. The method of claim 14, further comprising:

rejecting, with the filter, a first range of frequencies within the operational frequency range based on a first tuning of the filter; and rejecting, with the filter, a second range of frequencies within the operational frequency range based on a second tuning of the filter.

18. The method of claim 14, wherein the at least one non-resonant node and the combline filter are integral to the filter.

19. A filter configured to operate in a plurality of frequency ranges, the filter comprising:

a plurality of combline resonators that are configured to resonate in a passband region, wherein the passband region is a range of frequencies that are not significantly filtered by a combline filter;

a plurality of non-resonant nodes disposed along a central axis that are configured to resonate in a rejection region, wherein the rejection region is a range of frequencies that are minimized by notch filters, wherein subsets of the plurality of combline resonators are located on opposite sides of the central axis; and a plurality of combline coupling elements that are configured to respectively couple each combline resonator to a respective non-resonant node.

20. The filter of claim 19, wherein the range of frequencies in the passband region are not significantly filtered when a non-resonant node filter is tuned to the rejection region.

* * * * *